US006659086B2

(12) United States Patent
Rodriguez-Amaya et al.

(10) Patent No.: US 6,659,086 B2
(45) Date of Patent: Dec. 9, 2003

(54) FUEL INJECTION APPARATUS FOR INTERNAL COMBUSTION ENGINES

(75) Inventors: Nestor Rodriguez-Amaya, Stuttgart (DE); Roger Potschin, Brackenheim (DE); Juergen Gruen, Ditzingen (DE); Ulrich Projahn, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/101,712

(22) Filed: Mar. 21, 2002

(65) Prior Publication Data

US 2002/0134359 A1 Sep. 26, 2002

(30) Foreign Application Priority Data

Mar. 21, 2001 (DE) ..... 101 13 654

(51) Int. Cl.[7] ..... F02M 37/04
(52) U.S. Cl. ..... 123/467; 123/496; 123/300
(58) Field of Search ..... 123/496, 506, 123/299, 300, 467, 500, 501

(56) References Cited

U.S. PATENT DOCUMENTS 4,643,155 A * 2/1987 O'Neill ..... 123/506
4,784,101 A * 11/1988 Iwanaga et al. ..... 123/446
5,711,279 A * 1/1998 Green et al. ..... 123/506
5,732,679 A * 3/1998 Takahasi et al. ..... 123/467
5,893,350 A * 4/1999 Timms ..... 123/467
6,189,509 B1 * 2/2001 Froment ..... 123/467
6,253,734 B1 * 7/2001 Rembold et al. ..... 123/446
6,328,017 B1 * 12/2001 Heinz et al. ..... 123/467

* cited by examiner

*Primary Examiner*—Carl S. Miller
(74) *Attorney, Agent, or Firm*—Ronald E. Greigg

(57) ABSTRACT

The fuel injection apparatus has one fuel pump for each cylinder of the engine, which pump has a pump piston, driven by the engine in a reciprocating motion, that defines a pump work chamber, which communicates via a line with a fuel injection valve, disposed on the engine separately from the fuel pump, which valve has an injection valve member, by which at least one injection opening is controlled, and which is movable in the opening direction, counter to a closing force, by the pressure generated in the pump work chamber, and at least one first electrically triggered control valve is provided, by which a communication of the pump work chamber with a relief chamber is controlled, and which is disposed near the fuel pump. A second electrically triggered control valve is provided, which is disposed near the fuel injection valve and by which the pressure prevailing in a control pressure chamber of the fuel injection valve is controlled, by which pressure the injection valve member is urged at least indirectly in the closing direction.

8 Claims, 3 Drawing Sheets

Fig. 5
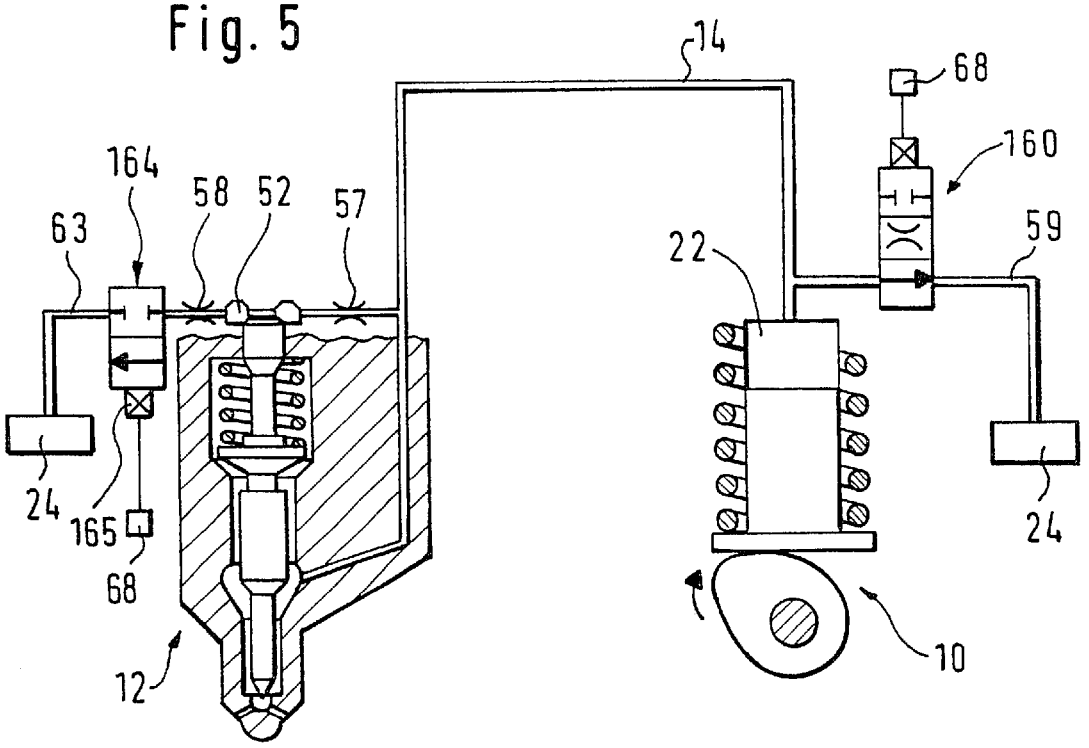
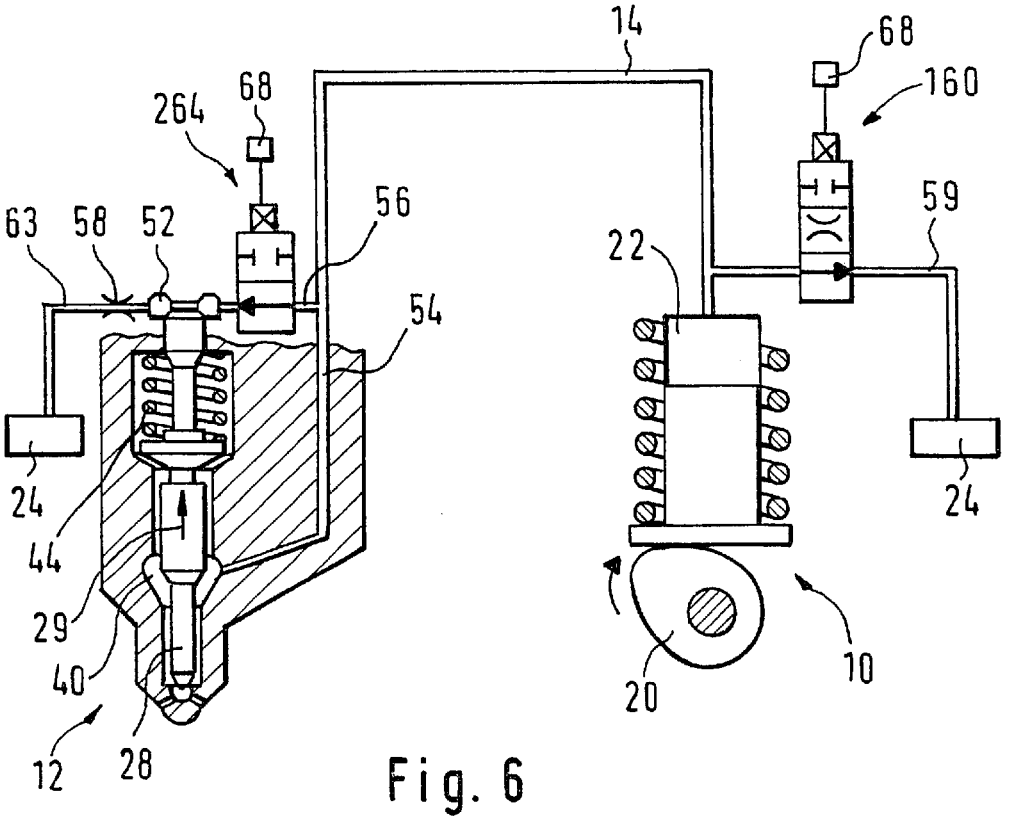
Fig. 6

FUEL INJECTION APPARATUS FOR INTERNAL COMBUSTION ENGINES

BACKGROUND OF THE INVENTION

1. Field of the Invention

The invention is directed to an improved fuel injection apparatus for internal combustion engines having a fuel pump for each engine cylinder.

2. Description of the Prior Art

One fuel injection apparatus of the type with which this invention is concerned is known from the literature, for instance from the textbook entitled *Dieselmotor-Management* [Diesel Engine Management], 2nd Ed., Verlag Vieweg, page 299. This known fuel injection apparatus, for each cylinder of the engine, has one fuel pump, one fuel injection valve, and one line connecting the fuel injection valve to the fuel pump. The fuel pump has a pump piston, driven in a reciprocating motion, that defines a pump work chamber. Near the fuel pump is a control valve, by which a communication of the pump work chamber with a relief chamber is controlled. The fuel injection valve has an injection valve member, by which at least one injection opening is controlled and which is movable in the opening direction counter to a closing force by means of the pressure generated in the pump work chamber by the fuel pump. By means of the control valve, the instant and duration of opening of the fuel injection valve can be controlled; the instant of opening is determined by providing that the pump work chamber is disconnected from the relief chamber by the control valve, and thus the high pressure generated by the fuel pump in the pump work chamber is operative. For closure of the fuel injection valve, the pump work chamber of the fuel pump is made to communicate with the relief chamber by the control valve, so that no further high pressure is operative in the pump work chamber, and the fuel injection valve is closed by the closing force acting on the injection valve member. The control valve is-disconnected by means of the line and is located relatively far from the fuel injection valve, so that when the communication of the pump work chamber with the relief chamber is opened by the control valve, the pressure at the fuel injection valve drops only in delayed fashion, and accordingly the fuel injection valve closes only with a delay, so that the instant and duration of opening of the fuel injection valve can be determined only imprecisely. A brief opening and closure of the fuel injection valve for a preinjection and postinjection that are chronologically offset from a main injection is thus feasible only with difficulty.

OBJECT AND SUMMARY OF THE INVENTION

The fuel injection apparatus of the invention has the advantage over the prior art that by means of a second control valve, a fast, undelayed closure of the fuel injection valve is made possible, as is necessary in particular to make a preinjection and postinjection that are chronologically offset from a main injection possible. To close the fuel injection valve, a high pressure is established by the second control valve in the pressure chamber of the fuel injection valve, and by this pressure the injection valve member is urged in the closing direction.

BRIEF DESCRIPTION OF THE DRAWINGS

The invention will be better understood and further objects and advantages thereof will become more apparent from the ensuing detailed description of preferred embodiments taken in conjunction with the drawings.

FIG. 5 shows the fuel injection apparatus in a third exemplary embodiment; and FIG. 6 shows the fuel injection apparatus in a fourth exemplary embodiment.

DESCRIPTION OF THE PREFERRED EMBODIMENTS

Figure 1:
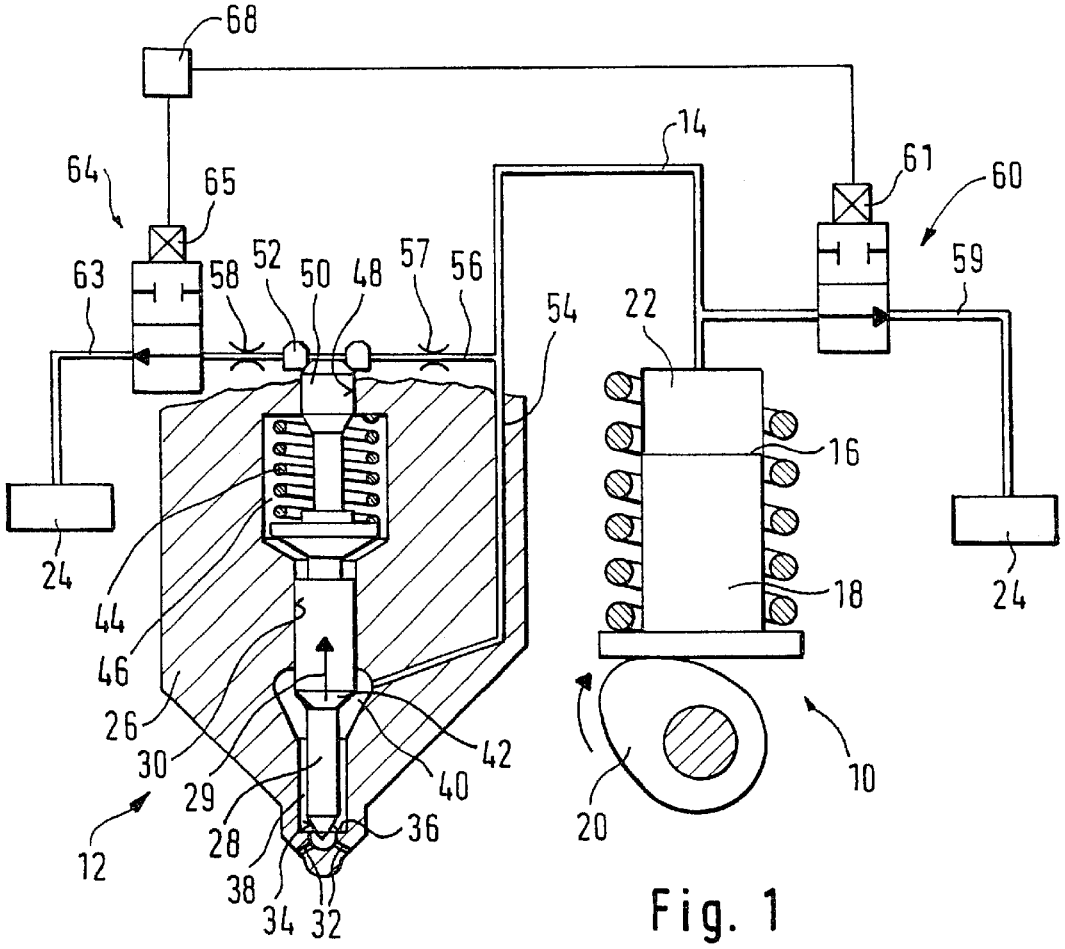
FIG. 1 shows a fuel injection apparatus for an internal combustion engine schematically in a first exemplary embodiment.

In FIGS. 1, 3, 5 and 6, a fuel injection apparatus for an internal combustion engine of a motor vehicle is shown. The fuel injection apparatus is preferably embodied as a so-called pump-line-nozzle system and for each cylinder of the engine has one fuel pump 10, one fuel injection valve 12, and one line 14 connecting the fuel injection valve 12 to the fuel pump 10. The fuel pump 10 has a pump piston 18, guided tightly in a cylinder 16 and driven in a reciprocating motion by a cam 20 of a camshaft of the engine. In the cylinder 16, the pump piston 18 defines a pump work chamber 22, in which fuel is compressed at high pressure by the pump piston 18. By means of a low-pressure pump, not shown, for instance, fuel from a fuel tank 24 is delivered to the pump work chamber 22.

The fuel injection valve 12 is disposed separately from the fuel pump 10 and communicates with the pump work chamber 22 via the line 14. The fuel injection valve 12 has a valve body 26, which may be embodied in multiple parts and in which a piston-like injection valve member 28 is guided longitudinally displaceably in a bore 30. The valve body 26, in its end region oriented toward the combustion chamber of the cylinder of the engine, has at least one and preferably a plurality of injection openings 32. The injection valve member 28, in its end region toward the combustion chamber, has a sealing face 34, which for instance is approximately conical, and which cooperates with a valve seat 36, embodied in the valve body 26 in its end region toward the combustion chamber; the injection openings 32 lead away from or downstream of this valve seat. In the valve body 26, between the injection valve member 28 and the bore 30, toward the valve seat 36, there is an annular chamber 38, which as a result of a radial widening of the bore 30 changes over into a pressure chamber 40 surrounding the injection valve member 28. The injection valve member 28 has a pressure shoulder 42 In the region of the pressure chamber 40. The end remote from the combustion chamber of the injection valve member 28 is engaged by a prestressed closing spring 44, by which the injection valve member 28 is pressed toward the valve seat 36. The closing spring 44 is disposed in a spring chamber 46 of the valve body 26 that adjoins the bore 30. The spring chamber 46 is adjoined, on its end remote from the bore 30, in the valve body 26 by a further bore 48, in which a piston 50 that is joined to the injection valve member 28 is tightly guided. The piston 50, with its end face remote from the injection valve member 28, defines a control pressure chamber 52 in the valve body 26. Embodied in the valve body 26 is a conduit 54, into which the line 14 to the fuel pump 10 discharges and which itself discharges into the pressure chamber 40, and from which a communication 56 branches off to the control pressure chamber 52.

The fuel injection apparatus has a first control valve 60, disposed near the fuel pump 10, that can for instance be integrated with the fuel pump 10. By means of the first control valve 60, a communication 59 of the pump work chamber 22 with a relief chamber 24 is controlled; the relief chamber is for instance the fuel tank 24, or some other region in which a low pressure prevails. The first control valve 60 is electrically triggerable and has an actuator 61, which can be an electromagnet or a piezoelectric actuator and is electrically triggered and by which a valve member of the control valve 60 is movable. The first control valve 60 can be embodied as either pressure-balanced or not.

In a first exemplary embodiment of the fuel injection apparatus, shown in FIG. 1, the first control valve 60 is embodied as a 2/2-way valve. In a first switching position of the control valve 60, the communication 59 of the pump work chamber 22 of the fuel pump 10 with the relief chamber 24 is opened by this valve, so that a high pressure cannot build up in the pump work chamber 22. In a second switching position, by means of the control valve 60 the communication 59 of the pump work chamber 22 with the relief chamber 24 is broken, so that in the pump work chamber 22, in the pumping stroke of the pump piston 18, high pressure can build up. The fuel injection apparatus furthermore has a second control valve 64, disposed near the fuel injection valve 12, by means of which control valve a communication 63 of the control pressure chamber 52 of the fuel injection valve 12 with a relief chamber is controlled; the relief chamber is the fuel tank 24 or some other region where a low pressure prevails. The control valve 64 is electrically controllable and has an actuator 65, which may be an electromagnet or a piezoelectric actuator, and which is electrically triggered and by which a valve member of the control valve 64 is movable. The second control valve 64 is embodied as a 2/2-way valve; in a first switching position, the communication 63 of the control pressure chamber 52 with the relief chamber 24 is opened by the control valve 64, and in a second switching position the communication 63 of the control pressure chamber 52 with the relief chamber 24 is broken. The second control valve 64 is preferably embodied in pressure-balanced form. A throttle restriction 57 is disposed in the communication 56 of the control pressure chamber 52 with the conduit 54. A throttle restriction 58 is also disposed in the communication 63 of the control pressure chamber 52 with the relief chamber 24. The first control valve 60, in the untriggered or in other words currentless state, is in a switching position in which the communication 59 of the pump work chamber 22 with the relief chamber 24 is open. The second control valve 64, in the nontriggered or in other words currentless state, is in its switching position in which the communication 63 of the control pressure chamber 52 with the relief chamber 24 is open.

The function of the fuel injection apparatus in the first exemplary embodiment will now be explained. The control valves 60, 64 are triggered by an electric control unit 68. In the intake stroke of the pump piston 18, the first control valve 60 is opened, so that the pump work chamber 22 communicates with the relief chamber 24. When the injection is to begin, the first control valve 60 is closed by suitable triggering by the control unit 68, so that the pump work chamber 22 is disconnected from the relief chamber 24, and a high pressure builds up in it. The pressure prevailing in the pump work chamber 22 is also operative in the pressure chamber 40, via the line 14 and the conduit 54 in the valve body 26. The second control valve 64 is kept open by the control unit 68, so that a high pressure cannot build up in the control pressure chamber 52 and instead this pressure is relieved to the relief chamber 24. By means of the throttle restrictions 57, 58, it is attained that only a slight quantity of fuel can flow out of the conduit 54 into the relief chamber 24. By means of the high pressure acting in the pressure chamber 40 on the pressure shoulder 42 of the injection valve member 28, the injection valve member 28 is moved in the opening direction 29 counter to the force of the closing spring 44, so that the injection valve member uncovers the injection openings 42, and fuel is injected into the combustion chamber of the cylinder.

Figure 2:
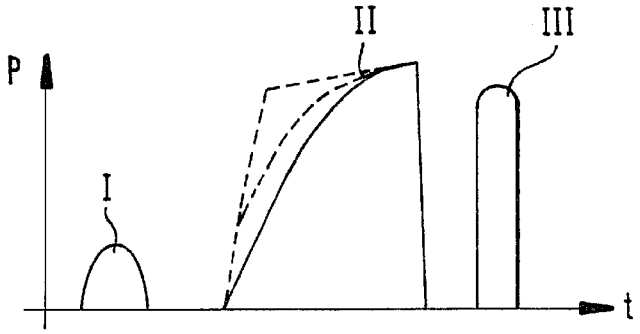
FIG. 2 shows a pressure course at injection openings of a fuel injection valve of the fuel injection apparatus in the first exemplary embodiment.

After that, the first control valve 60 is closed again by the control unit 68, so that fuel can flow out of the pump work chamber 22 into the relief chamber 24, and the high pressure is relieved. Accordingly, the pressure in the pressure chamber 40 of the fuel injection valve 12 drops as well, so that by the force of the closing spring 44, the injection valve member 28 is moved with its sealing face 34 into contact with the valve seat 36 and closes the injection openings 32, thus interrupting the injection. Because of the profile of the cam 20 that brings about the reciprocating motion of the pump piston 18, only a relatively slight pressure builds up in the pump work chamber 22 and thus in the pressure chamber 40 of the fuel injection valve 12 during the first injection phase, which is a preinjection, and thus the preinjection occurs at a correspondingly low pressure and in an only slight quantity. In FIG. 2, the course of the pressure P at the injection openings 32 of the fuel injection valve 12 is shown over the time t during one complete injection cycle. The phase I represents the preinjection.

Next, the first control valve 60 is closed again by the control unit 68, so that high pressure builds up in the pump work chamber 22 and in the pressure chamber 40 of the fuel injection valve 12, as a function of the profile of the cam 20. By means of the high pressure, the fuel injection valve 12 is opened again, and a fuel injection through the injection openings 32 into the combustion chamber of the cylinder ensues, with a main injection at a higher injection pressure and in a greater injection quantity than in the preceding preinjection. The course of the pressure at the injection openings 32 during the main injection is shown as phase II in FIG. 2.

The second control valve 64 can remain open during the preinjection and during the main injection, so that the control pressure chamber 52 is in communication with the relief chamber 24. It can also be provided that the second control valve 64 is closed after the preinjection, so that no further fuel can flow out of the control pressure chamber 52 into the relief chamber 24, and the same pressure as in the pump work chamber 22 and in the pressure chamber 40 builds up in the control pressure chamber 52 as well. If for the main-injection the first control valve 60 is closed again, then the second control valve 64 can still be kept closed, so that in the control pressure chamber 52, the same high pressure as in the pump work chamber 22 and in the pressure chamber 40 builds up. By means of the high pressure in the control pressure chamber 52, a force acting in the closing direction, that is, counter to the opening direction 29, acting on the piston 50 and thus on the injection valve member 28 is generated, so that the injection valve member 28 is kept with its sealing face 34 in contact with the valve seat 36 and closes the injection openings 32, so that no injection occurs. The pressure in the pump work chamber 22 and in the pressure chamber 40 builds up in accordance with the profile of the cam 20. Not until the second control valve 64 is opened and thus the high pressure in the control pressure chamber 52 is relieved to the relief chamber 24 can the fuel injection valve 12 open, as a result of the movement of the injection valve member 28 in the opening direction 29 by the high pressure prevailing in the pressure chamber 40, counter to the force of the closing spring 44. Thus because of the delayed opening of the second control valve 64, the opening pressure of the fuel injection valve 12 can be raised, as is represented by dashed lines in FIG. 2 for the main injection phase II.

For terminating the main injection, the second control valve 64 is closed, so that the control pressure chamber 52 is disconnected from the relief chamber 24, and the high pressure of the pump work chamber 22 builds up in it. By the high pressure in the control pressure chamber 52, the fuel injection valve 12 is closed and the fuel injection is interrupted. The first control valve 60 can either remain closed or be open. For a postinjection of fuel, the second control valve 64 is opened again, so that the control pressure chamber 52 is relieved, and the fuel injection valve 12 is opened again by the high pressure still prevailing in the pump work chamber 22 and in the pressure chamber 40. The postinjection is shown in FIG. 2 as injection phase III. The postinjection takes place at high pressure, which is generated by the corresponding profile of the cam 20. The first control valve 60 is closed during the postinjection. To terminate the fuel injection, the first control valve 60 is opened, so that the pump work chamber 22 is relieved, and the fuel injection valve 12 closes by the force of the closing spring 44. The second control valve 64 can be in either its closed or open position then.

Figure 3:
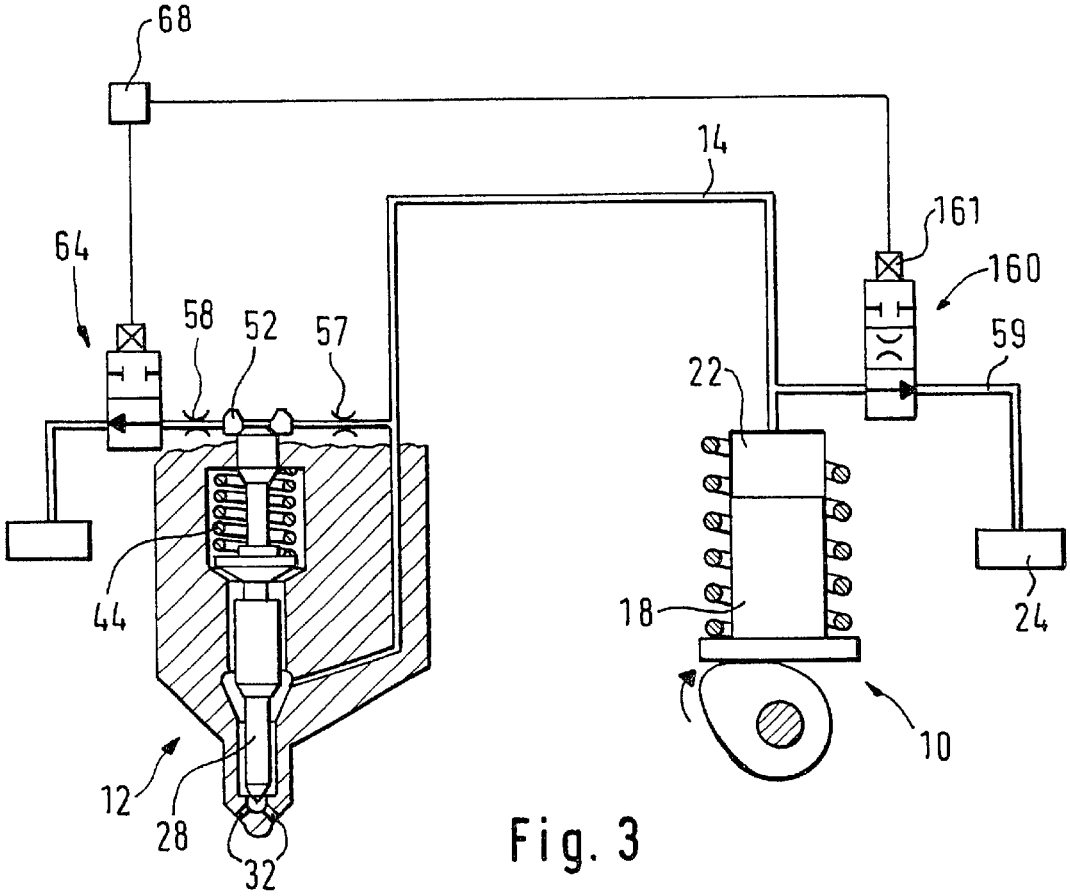
FIG. 3 shows a course of a pressure at injection openings of a fuel injection valve of the fuel injection apparatus.

In FIG. 3, the fuel injection apparatus is shown in a second exemplary embodiment, in which the layout is essentially the same as in the first exemplary embodiment and only the first control valve 160 is modified. The first control valve 160 has an electrically triggerable actuator 161, in the form of an electromagnet or a piezoelectric actuator, by which a valve member of the control valve 160 is movable. The control valve 160 is embodied as a 2/3-way-valve and can accordingly assume three switching positions. In a first switching position, the communication 59 of the pump work chamber 22 with the relief chamber 24 is fully opened by the control valve 160. In a second switching position, the communication 59 of the pump work chamber 22 with the relief chamber 24 is opened by the control valve 160 via a throttled passage, and in a third switching position the communication 59 of the pump work chamber 22 with the relief chamber 24 is broken by the control valve 160. The second switching position of the control valve 160 can be achieved by providing that its valve member, as a result of the actuator 161, executes only a partial stroke and thus opens only a smaller flow cross section than in the first switching position. The triggering of the first control valve 160 by the control unit 68 is in principle the same as is described above for the first exemplary embodiment; at the onset of the main injection, the control valve 160 is moved into its second switching position, in which the pump work chamber 22 has a throttled communication with the relief chamber 24. By means of this throttled communication, it is attained that some of the fuel pumped by the pump piston 18 flows out into the relief chamber 24, and as a result the pressure in the pump work chamber 22 reaches only a lesser height than when the control valve 160 is fully closed. As a result, it is attained that at the onset of the main injection, the fuel injection takes place at only a relatively slight pressure, as is illustrated in FIG. 4, which again shows the course of the pressure at the injection openings 32 of the fuel injection valve 12. At a certain instant, the control unit 68 moves the first control valve 160 into its third switching position, in which the pump work chamber 22 is disconnected from the relief chamber 24, and the full high pressure corresponding to the profile of the cam 20 is established in the pump work chamber 22 and thus at the injection openings 32 of the fuel injection valve 12. The instant of the full pressure rise in the pump work chamber 22 is determined by the instant of closure of the first control valve 160.

Figure 4:
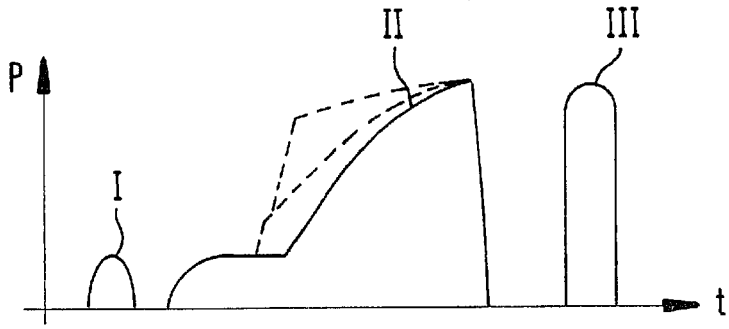
FIG. 4 is a detail of a modified version of the fuel injection apparatus in the second exemplary embodiment.

Otherwise, the triggering of the first control valve 160 and of the second control valve 64 by the control unit 68 is the same as has been described for the first exemplary embodiment, and thus the pressure course at the injection openings 32 shown in FIG. 4 results, with the preinjection phase I, the main injection phase II with a graduated pressure buildup, and the postinjection phase III. By a delayed opening of the second control valve 64, the opening pressure of the fuel injection valve 12 can again be increased, as is represented in FIG. 4 by the dashed line showing the course of the main injection phase II.

In FIG. 5, the fuel injection apparatus in a third exemplary embodiment is shown, in which the basic layout is as in the first or second exemplary embodiment, and only the second control valve 164 has been modified. The second control valve 164 is embodied as a 2/2-way valve, but in a departure from the first and second exemplary embodiments, in the nontriggered or in other words currentless state of its actuator 165, this control valve is in a switching position in which the communication 63 of the control pressure chamber 52 with the relief chamber 24 is broken. This is advantageous for safety reasons, in order to assure that in the event of an interruption in the electrical connection between the second control valve 164 and the control unit 68 to assure that the fuel injection valve 12 cannot open in response to the high pressure then building up in the control pressure chamber 52.

In FIG. 6, the fuel injection apparatus is shown in a fourth exemplary embodiment, in which the basic layout is again the same as in the exemplary embodiments explained above, and only the disposition of the second control valve 264 is modified. The second control valve 264 is disposed in the communication 56 of the control pressure chamber 52 with the conduit 54 and is embodied as a 2/2-way valve. A throttle restriction 58 is disposed in the communication 63 of the control pressure chamber 52 with the relief chamber 24. By means of the second control valve 264, the communication 56 of the control pressure chamber 52 with the conduit 54 and thus with the pump work chamber 22 of the fuel pump 10 is controlled. The first control valve 160 can be a 2/2-way valve, or as shown in FIG. 6, it may a 2/3-way valve.

The function of the fuel injection apparatus in the fourth exemplary embodiment, to attain a pressure course of the kind shown in FIG. 4, will now be explained. For a preinjection in accordance with phase I of the pressure course in FIG. 4, the first control valve 160 is closed by the control unit 68, so that the pump work chamber 22 is disconnected from the relief chamber 24, and high pressure builds up in the pump work chamber 22. The second control valve 264 is likewise closed, so that the control pressure chamber 52 is disconnected from the conduit 54 and thus from the pump work chamber 22 and is relieved to the relief chamber 24 via the communication 63. Because of the high pressure operative in the pressure chamber 40 of the fuel injection valve 12, the fuel injection valve 12 opens because its injection valve member 28 is moved in the opening direction 29, counter to the force of the closing spring 44. To terminate the preinjection, the first control valve 160 is opened, so that the pump work chamber 22 communicates with the relief chamber 24; as a result, the pressure in the pump work chamber 22 and in the pressure chamber 40 drops such that the fuel injection valve 12 closes in response to the force of the closing spring 44, which exceeds the pressure force exerted on the injection valve member 28. In addition, the second control valve 264 can also be opened, so that the control pressure chamber 52 communicates with the conduit 54 and thus with the pump work chamber 22.

For the main injection in accordance with phase II of the pressure course in FIG. 4, the first control valve 160 is moved by the control unit 68 into its second switching position, in which the pump work chamber 22 has the throttled communication with the relief chamber 24, so that only a reduced pressure can build up in the pump work chamber 22. The second control valve 264 is closed, and thus the control pressure chamber 52 is relieved to the relief chamber 24. As a result of the pressure prevailing in the pressure chamber 40, the fuel injection valve 12 opens, and a fuel injection at slight pressure ensues. Next, the first control valve 160 is put into its closed switching position by the control unit 68, so that the full high pressure corresponding to the profile of the cam 20 builds up in the pump work chamber 22. A fuel injection through the fuel injection valve 12 now takes place at high pressure.

To terminate the main injection, the second control valve 264 is opened by the control unit 68, so that the high pressure of the pump work chamber 22 is operative in the control pressure chamber 52, which reinforces the force of the closing spring 44 via the piston 50, so that the injection valve member 28 is moved in the closing direction and closes the fuel injection valve 12. For a postinjection in accordance with phase III in FIG. 4, the second control valve 264 is closed again by the control unit 68, so that the control pressure chamber 52 is relieved to the relief chamber 24, and because of the high pressure prevailing in the pressure chamber 40 the injection valve member 28 is moved in the opening direction 29 and opens the fuel injection valve 12. The postinjection is effected at high pressure and is terminated by providing that the first control valve 160 is opened by the control unit 68, so that the pressure in the pump work chamber 22 is relieved to the relief chamber 24. In addition, the second control valve 264 can also be opened by the control unit 68, thus reinforcing the closure of the fuel injection valve 12.

The foregoing relates to preferred exemplary embodiments of the invention, it being understood that other variants and embodiments thereof are possible within the spirit and scope of the invention, the latter being defined by the appended claims.

We claim:

1. A fuel injection apparatus for internal combustion engines, the apparatus comprising one fuel pump (10) for each cylinder of the engine, which pump has a pump piston (18), driven by the engine in a reciprocating motion, that defines a pump work chamber (22), which communicates via a line (14) with a fuel injection valve (12), disposed on the engine separately from the fuel pump (10), which valve has an injection valve member (28), by which at least one injection opening (32) is controlled, and which is movable in the opening direction (29), counter to a closing force, by the pressure generated in the pump work chamber (22), at least one first electrically triggered control valve (160) by which a communication (59) of the pump work chamber (22) with a relief chamber (24) is controlled, the first control valve (160) being disposed near the fuel pump (10), and a second electrically triggered control valve (64; 164; 264) which is disposed near the fuel injection valve (12) and by which the pressure prevailing in a control pressure chamber (52) of the fuel injection valve (12) is controlled, by which pressure the injection valve member (28) is urged at least indirectly in the closing direction, wherein the first control valve (160) can assume three switching positions, and wherein a first switching position the pump work chamber (22) is disconnected from the relief chamber (24); in a second switching position the pump work chamber (22) has a throttled communication with the relief chamber (24); and in a third switching position the pump work chamber (22) has a less severely throttled or an unthrottled communication with the relief chamber (24).

2. The fuel injection apparatus according to claim 1 wherein a communication (56) of the control pressure chamber (52) with the pump work chamber (22) is controlled by the second control valve (264).

3. A fuel injection apparatus for internal combustion engines, the apparatus comprising one fuel pump (10) for each cylinder of the engine, which pump has a pump piston (18), driven by the engine in a reciprocating motion, that defines a pump work chamber (22), which communicates via a line (14) with a fuel injection valve (12), disposed on the engine separately from the fuel pump (10), which valve has an injection valve member (28), by which at least one injection opening (32) is controlled, and which is movable in the opening direction (29), counter to a closing force, by the pressure generated in the pump work chamber (22), at least one first electrically triggered control valve (60; 160) by which a communication (59) of the pump work chamber (22) with a relief chamber (24) is controlled, the first control valve (60; 160) being disposed near the fuel pump (10), and a second electrically triggered control valve (64; 164; 264) which is disposed near the fuel injection valve (12) and by which the pressure prevailing in a control pressure chamber (52) of the fuel injection valve (12) is controlled, by which pressure the injection valve member (28) is urged at least indirectly in the closing direction wherein a communication (56) of the control pressure chamber (52) with the pump work chamber (22) is controlled by the second control valve (264) and wherein the control pressure chamber (52) has a continuously open communication (63) with a relief chamber (24), and at least one throttle restriction (58) is provided in the communication (63).

4. The fuel injection apparatus according to claim 1 wherein a communication (63) of the control pressure chamber (52) with a relief chamber (24) is controlled by the second control valve (64; 164), and that the control pressure chamber (52) has a continuously open communication (56) with the pump work chamber (22), in which communication at least one throttle restriction (57) is provided.

5. The fuel injection apparatus according to claim 4 wherein, in the communication (63), controlled by the second control valve (64; 164), of the control pressure chamber (52) with the relief chamber (24), at least one throttle restriction (58) is provided.

6. The fuel injection apparatus according to claim 4 wherein the second control valve (164), in the non-triggered, currentless state, is in a switching position in which the control pressure chamber (52) is disconnected from the relief chamber (24).

7. The fuel injection apparatus according to claim 5 wherein the second control valve (164), in the non-triggered, currentless state, is in a switching position in which the control pressure chamber (52) is disconnected from the relief chamber (24).

8. The fuel injection apparatus according to claim 3 wherein the first control valve (160) can assume three switching positions, and wherein a first switching position the pump work chamber (22) is disconnected from the relief chamber (24); in a second switching position the pump work chamber (22) has a throttled communication with the relief chamber (24); and in a third switching position the pump work chamber (22) has a less severely throttled or an unthrottled communication with the relief chamber (24).

* * * * *